United States Patent [19]

Myers

[11] Patent Number: 4,899,561

[45] Date of Patent: Feb. 13, 1990

[54] POP-OUT HANDLE LOCK ASSEMBLY

[75] Inventor: Gary L. Myers, River Grove, Ill.

[73] Assignee: Fort Lock Corporation, River Grove, Ill.

[21] Appl. No.: 335,229

[22] Filed: Apr. 10, 1989

[51] Int. Cl.[4] ..... E05B 13/10

[52] U.S. Cl. ..... 70/208; 70/379 R; 292/358

[58] Field of Search ..... 70/208, 379 R, 379 A; 292/DIG. 31, 251, 336.5, 358

[56] References Cited

U.S. PATENT DOCUMENTS

| | | | |
|---|---|---|---|
| 2,660,046 | 11/1953 | Jacobi | 70/379 R |
| 3,285,043 | 11/1966 | Dauenbaugh et al. | 70/208 |
| 4,552,001 | 11/1985 | Roop | 70/208 |

FOREIGN PATENT DOCUMENTS

| | | | |
|---|---|---|---|
| 789242 | 7/1968 | Canada | 70/208 |
| 9431 | 11/1896 | Sweden | 70/208 |
| 1121897 | 7/1968 | United Kingdom | 70/208 |

*Primary Examiner*—Lloyd A. Gall
*Attorney, Agent, or Firm*—Leydig, Voit & Mayer

[57] ABSTRACT

A pop-out handle lock assembly wherein the handle engagement and connecting means is a two part construction including a rotatable shaft having a head end with a transverse slot and a generally T-shaped holder member made of flat sheet material is pivotally held in the slotted head end of the shaft so as to eliminate binding or interference with the freedom of the handle to pop out or to be pushed into the locked retracted position.

4 Claims, 2 Drawing Sheets

POP-OUT HANDLE LOCK ASSEMBLY

FIELD OF THE INVENTION

The present invention relates generally to pop-out handle lock assemblies for cabinet doors such as those commonly provided on a refrigerated vending machine or the like. In particular, the invention has reference to a pop-out handle lock assembly of the nested handle type which is mountable on the outside of a cabinet door, and when the door is in the locked condition, the handle may be pushed into a recess which is inaccessible for unauthorized manipulation.

BACKGROUND OF THE INVENTION

Nested handle door lock assemblies for vending machine cabinets are widely utilized and have been well known in the prior art. Indeed, the recognition of this common usage is illustrated by the fact that dimensional standards have been set forth by NAMA (National Automatic Merchandising Association) and ASTM (American Society of Testing Materials). Moreover, a considerable number of patents have been issued on numerous different aspects of such pop-out handle assemblies as illustrated, for example, in Roop U.S. Pat. No. 4,552,001 and the numerous patent references identified therein which span a time period of over 60 years.

Such lock mechanisms commonly employ a housing of cylindrical structure having an integral rim flange which fits flush against the outside face of a door panel with the cylindrical portion projecting rearwardly through an opening in the door panel. Mounting screws or bolts extend through the countersunk holes in the rim flange underneath the handle to secure the lock housing against the door panel. Typically, a T-shaped handle containing the lock mechanism is received by the rim flange housing and when the lock mechanism is operated by a proper key, the handle pops out to render it accessible for manipulation to open or close the cabinet door. When the handle is turned to the door locking position, it can then be pushed in to nest within the recess of the rim flange housing where it becomes essentially flush with the rim and remains inaccessible to any attempted manipulation of the handle.

In addition to various types of key operated locks mounted in the handle portion, there have also been various types of locking mechanisms carried by the rim flange housing which affect the manner in which the door is opened and closed as well as for drawing a door tightly against a sealing gasket such as used in refrigerated vending machine cabinets. Typically, the rim flange housing carries a rotatable bolt member that has external threads and is threadably received in an internally threaded nut member on the cabinet with multiple rotational turns of the handle affecting the opening and closing. Alternatively, the bolt member can carry a cam latch or a bayonet connector member where the opening is accomplished by some fractional rotation of the handle such as what is commonly referred to as a ¼ turn locking and unlocking operation. In either event, in many of the previous constructions, due to misalignments which occur between the lock assembly and cabinet connecting members there can be a slight bending moment on the rim flange housing which in turn can cause a binding with the nested lock handle that interferes either with the freedom of the handle to pop out or the ability to be easily pushed manually into the nested position.

One previous attempt to solve this problem was the provision of a universal type joint in the bolt member that would allow it to be self-aligning and avoid transmittal of a bending moment back up through the components to the handle. While the universal joint arrangement did provide a solution to the problem, it also was a complex machined arrangement that significantly added to the costs and difficulties of manufacture and assembly.

OBJECTS AND SUMMARY OF THE INVENTION

The general aim of the present invention is to provide a new and improved pop-out handle lock construction which will accommodate the misalignments of the connecting elements while permitting satisfactory operation of the mounted handle lock by avoiding interference with the inward and outward movement of the pop out handle portion.

More specifically, it is an object of the invention to provide a pop-out handle lock construction of the foregoing type wherein a relatively simple and inexpensive to manufacture pivotal type connection may be provided at reduced production and assembly operations. It is yet another object of the invention to provide such an improved pivotal type arrangement that may be utilized with either screw type or fractional turn type connectors while utilizing the same inner handle core constructions.

These and other advantages of the invention will be more apparent from the following detailed description when taken in conjunction with the accompanying drawings.

DETAILED DESCRIPTION OF THE PREFERRED EMBODIMENTS

Figure 1:
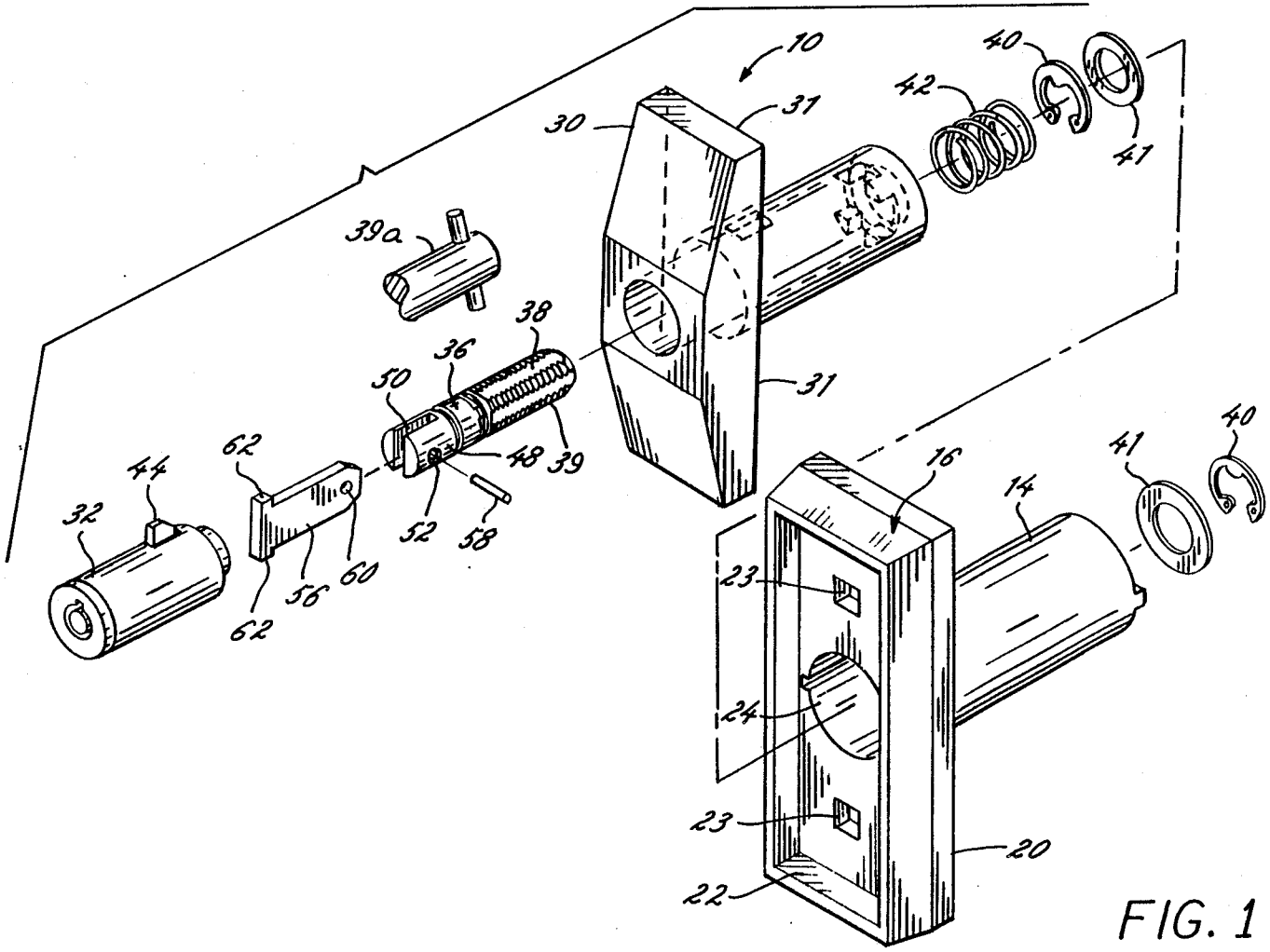
FIG. 1 is an exploded perspective view of a pop-up handle lock assembly embodying the present invention.
Figure 2:
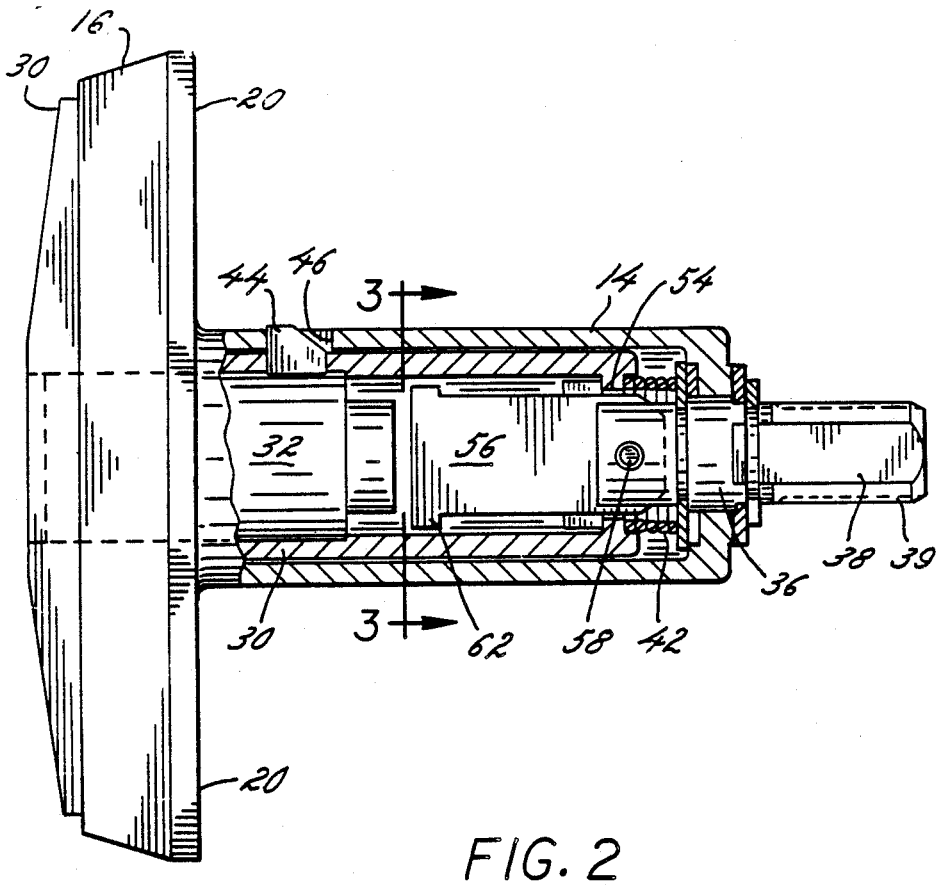
FIG. 2 is a vertical cross-sectional view of the assembled look construction of FIG. 1.
Figure 3:
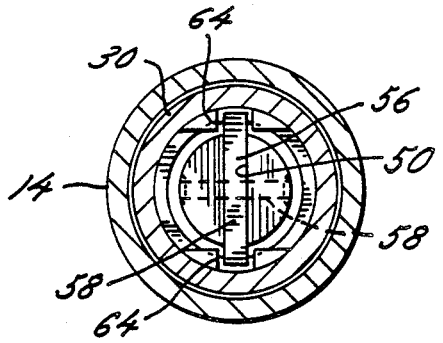
FIG. 3 is a sectional view taken along the line 3—3 of FIG. 2.

Turning to the drawings, there is illustrated in FIG. 1, a pop out handle lock assembly embodying the present invention, generally referred to at 10, and, for illustrative purposes, the assembly is shown in exploded form to identify each of its components.

Lock assembly 10 includes a generally cylindrical housing 14 projecting rearwardly (to the right in FIG. 1) from a stepped integral rim flange 16. The rim flange 16 has flats adapted to lay flush against the outside face of a door panel (not shown) which has a circular opening to receive the housing 14. The ear-like projections 20 of the rim flange include on the front face thereof, a shallow rectangular recess 22 and a pair of apertures 23 on the inner portion face of the recess serve to receive bolts (not shown) for mounting to a cabinet door. The housing 14 is configured internally with a hollow central bore 24 which together with the recess 22 conforms to and receives the T-handle 30 which in turn contains the lock mechanism 32. The operation of the lock by a proper key (not shown) is typical of such handle locks and reference to the aforementioned U.S. Pat. No. 4,552,001, as an example, should provide any details not necessary here for the discussion of the present invention. It should suffice to say that the pop-out handle 30 in its locked position recesses into the rim flange 16 housing such that there is no way to force turn the handle without using the proper key to first cause the handle 30 to pop out to its operating position. The handle as shown is T-shaped with arms 31, however, it could likewise be a single arm L-shaped handle.

At the rearward end of the rim flange housing 14 there is a central bearing opening that receives a shaft 36 having an outwardly projecting connecting portion 38 which in the present instance has external threads 39 thereon. The shaft 36 is fixedly mounted by retaining rings 40 and washers 41 such that it is free to rotate with respect to the housing 14.

Interposed between the inside rear end of the rim flange housing 14 and the outside inner end of the handle housing 30 is a compression spring 42 which serves to normally urge the handle housing 30 to its outwardly projecting position with respect to the rim flange housing 14. The lock mechanism has a radially extending latch bolt 44 that coacts with a corresponding shaped opening 46 in the flange housing 14. The arrangement is such that when the handle is pushed inwardly the latch bolt is compressed until it reaches the opening and then latches the handle to the housing 14 until the bolt is retracted by a proper key operating the locking mechanism. When the latch bolt is retracted, the handle 30 can pop out under the action of the compression spring 42.

At the forward end of the shaft 36, there is a head end 48 which contains a cross slot 50 and perpendicularly disposed pivot pin openings 52. The shaft head end projects into a central bearing opening 54 of the handle housing 30 when the handle housing is in its fully retracted position.

In accordance with the present invention, there is provided a generally T-shaped holder member 56, which is made of a flat plate-like material constructed to be pivotally mounted to the shaft head end within the cross slot 50 of the head and held in place with a pin 58 positioned within the cross head openings and an aperture 60 in the rearward end of the holder member. At the outer end of the T-shaped holder member 56, there are radially projecting arms 62 adapted to engage with slots 64 located adjacent the lower inner end of the handle housing cylindrical portion when the handle is in its fully outwardly extended position. The interengagement between the arms 62 and the slots 64 permit rotation of the holder and shaft 36 when the handle is rotated in its outward extended position. This rotation of the handle driving the shaft connecting end 38 permits, for example, screwing the shaft end into a corresponding internally threaded connecting member (now shown) fixed to the cabinet such as required for drawing the door tightly against a sealing gasket of a refrigerated vending machine. When the door is drawn tightly against the gasket and the handle arms 31 are aligned with the rim flange recess 22, the handle can then be pushed in and locked in place.

It will be appreciated that other forms of connecting ends can be substituted for the external threads 39 on the shaft member 36 such as a cross pin or bayonet-type connector 39*a* (FIG. 1) that is received in an opening having radially projecting slots which would make up a fractional turn connection such as that referred to as a quarter turn handle operation to lock and unlock the door.

In keeping with the invention, the holder member 56 is preferably made of stamped sheet metal which can be easily mass produced and avoids costly and complicated machining operations. Also, with the flat T-shaped holder member 56, the same handle housing 30 can be used for both fractional turn and screw-type connectors on the shaft 36.

The pivotal mounting arrangement between the T-shaped holder 56 and the shaft head 48 eliminates any bending moment transmittal due to misalignments of the shaft connecting member 39 and the corresponding cabinet connecting member as well as other possible binding so that the handle housing 30 does freely pop out when the latch bolt 44 is released by a key and it is also easily pushed into the flange housing for latching it in the retracted position.

I claim as my invention:

1. In a pop-out handle lock assembly containing a lock cylinder mechanism, the combination comprising:

(a) a cylindrical open-ended housing having at its front end a radially outwardly extending rim flange with a shallow elongated recess in the forward end of the flange, the rearward end of said housing having a first central bearing opening, (b) a handle housing having a cylindrical portion adapted to be telescopically received in a central cylindrical portion of the rim flange housing so as to be slidable inwardly and outwardly, the inner end of said handle housing having a second central bearing opening and the outer end of said handle housing having a central opening receiving the lock cylinder mechanism and at least one radially outwardly extending arm defining an operating handle shaped to be received in the rim flange recess when the handle is in its inward most locked position, (c) latch bolt means operated by said lock cylinder mechanism engageable with the cylindrical rim flange housing for maintaining said handle portion in its innermost locked position until released by an appropriate key in said lock cylinder mechanism to allow the handle to slide outwardly from said rim flange housing, (d) compression spring means disposed between the inside rear end of the rim flange cylindrical housing and the outside inner end of the handle cylindrical housing so as to normally urge said handle housing to its outwardly projecting position when the latch bolt is released, (e) shaft means fixedly rotatably mounted within the first central bearing opening of said cylindrical rim flange housing, the rearward end of said shaft means projecting outwardly and having connecting means thereon for coupling with a complementary locking member, the inward end of said shaft means having a head portion including a transverse slot and perpendicularly disposed pivot pin openings, said shaft head being adapted to project into the central bearing opening of said handle housing when the handle housing is in its fully retracted position, (f) a generally T-shaped holder member made of flat plate material having an aperture adjacent its lower end and adapted to be received in the transverse slot of the shaft head, the holder member being pivotally mounted to said shaft head by pin means positioned within the pivot pin openings and holder member aperture; and, (g) the outer end of said T-shaped holder member having radially projecting arms adapted to engage with slot means adjacent the lower inner end of the handle housing cylindrical portion when the handle is in its fully outwardly extended position so as to permit rotation of the holder member and shaft means upon rotation of the handle in its outward extended position.

2. A pop-out handle lock assembly as claimed in claim 1 wherein said pivotally mounted holder member is made of stamped sheet metal.

3. A pop-out handle lock assembly as claimed in claim 1 wherein said shaft means rearwardly projecting end portion has external threads.

4. A pop-out handle lock assembly as claimed in claim 1 wherein said shaft means outwardly projecting end has a fractional turn bayonet connecting means.

* * * * *